US007513367B2

(12) United States Patent
Wolpow

(10) Patent No.: US 7,513,367 B2
(45) Date of Patent: Apr. 7, 2009

(54) QUICK DISPENSE SYSTEM

(75) Inventor: Richard Wolpow, Newport Beach, CA (US)

(73) Assignee: Dispensing Solutions, Inc., Santa Ana, CA (US)

( * ) Notice: Subject to any disclaimer, the term of this patent is extended or adjusted under 35 U.S.C. 154(b) by 815 days.

(21) Appl. No.: 11/174,202

(22) Filed: Jul. 1, 2005

(65) Prior Publication Data

US 2007/0000934 A1 Jan. 4, 2007

(51) Int. Cl.
*B65D 83/04* (2006.01)

(52) U.S. Cl. ..... 206/528; 206/538; 206/828

(58) Field of Classification Search ..... 206/528, 206/529, 532, 534, 535, 536, 538, 775, 828
See application file for complete search history.

(56) References Cited

U.S. PATENT DOCUMENTS

| | | | | | |
|---|---|---|---|---|---|
| 4,418,823 | A * | 12/1983 | Romick | ..... | 206/538 |
| 4,436,205 | A * | 3/1984 | Horii | ..... | 206/530 |
| 5,267,650 | A * | 12/1993 | Gilbilisco | ..... | 206/534 |
| 5,377,841 | A * | 1/1995 | Varon | ..... | 206/570 |
| 2007/0295635 | A1 * | 12/2007 | Rivero | ..... | 206/538 |

OTHER PUBLICATIONS

Article from website: www.dispensingsolutionsinc.com "The Medicine Cabinet" (1 page), Dec. 5, 2001.

Article from website: www.dispensingsolutionsinc.com "Medication Errors: Is Unit-Dose Packaging the Solution?" (2 pages); Published Feb. 1998; Copyright 1998 Pharaceutical & Medical Packaging News.

Article from website: www.dispensingsolutionsinc.com "Dispensing Solutions and ePhysician Partner To Equip DSI's 'Dsystem' In-Office Drug-Dispensing With Handheld Electronic Prescribing" (2 pages); Nov. 1, 2001.

Article from website: www.dispensingsolutionsinc.com Dispensing Solutions, Inc. Has Prescription For Hassle: Free In-Office Dispensing (2 pages); Aug. 1, 2001.

Article from website: www.dispensingsolutionsinc.com "OC Register.com" "Digital Doctor" (3 pages); Dec. 5, 2001.

(Continued)

*Primary Examiner*—Jacob K Ackun, Jr.
(74) *Attorney, Agent, or Firm*—Stetina Brunda Garred & Brucker

(57) ABSTRACT

Provided as a drug dispensing system comprising a cabinet and at least one cartridge. A cabinet has opposing door portions which are hingedly attached to one another and which are configured to be closable against one another such as via a lock member. Each one of the door portions includes at least one shelf which defines a shelf depth and which has an upwardly turned lip extending along the length of the shelf. The cartridge has a cartridge depth that is sized to be complementary to the shelf depth such that the cartridge may be retained by the lip when the cartridge is stored on the shelf. Each one of the cartridges is configured to store a plurality of vials. A punch-out is disposed in a lower end of the cartridge and through which the vials may be dispensed from the cartridge. The cartridge itself may be comprised of a top panel, a bottom panel, a front panel, a back panel and a pair of side panels foldable connected to one another along a plurality of fold lines and to define an interior compartment that is sized and configured to dispensibly store the vials.

20 Claims, 5 Drawing Sheets

OTHER PUBLICATIONS

Article from website: www.cardinal.com Cardinal Health Announces PatientPak-340B Program To Deliver Unit of Use Medication Directly to Customers (2 pages); Jun. 16, 2004.

Article from website: www.pbmi.com "Rebate Contracting 101" (1 page); 2001.

* cited by examiner

QUICK DISPENSE SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates generally to systems for dispensing prescribed medications and, more particularly, to a drug dispensing system which enables physicians and approved staff members to conveniently and safely dispense medications from an office of a medical practice.

Traditional methods of dispensing prescribed medications are well known to consumers and medical practitioners. Typically, a consumer receives a drug prescription from a doctor and then proceeds to have the prescription filled by a separate retail pharmacy. Unfortunately, when separate entities are used for prescribing and providing medication, errors can be introduced into the dispensing process which results in improper dispensing of medication. The dispensing of incorrect drugs or the dispensing of proper drugs of incorrect strengths poses serious risks to patients which can lead to injury and even death.

To reduce such risks, doctors may provide on-site dispensing of certain prescriptions through the use of repackaged drugs. However, under Federal and State law, physicians must dispense only properly packaged and labeled drug products. More specifically, the Food and Drug Administration (FDA) as well as the Drug Enforcement Agency (DEA) require that drug products are repackaged in facilities under stringent quality and procedural standards. Using these standards and procedures, doctors can effectively maintain a comprehensive system for on-site dispensing of medical products while simultaneously providing for the tracking of medical products and/or other inventory maintained by a medical practice. In this manner, doctors can effectively track drug dispensing transactions such that doctors can know what drugs are available for dispensing and whether quantities of drugs on hand have reached critical levels.

Another desirable feature for on-site dispensing of medical supplies is a system that allows for convenient and quick dispensing of prescription drugs. In this regard, it is desirable that prescription drugs may be easily transferred from inventory to a storage and/or dispensing unit that may be quickly and easily refilled and from which prescription drugs may be quickly and easily dispensed. Such drugs are preferably selected from items that are most commonly prescribed for a doctor's patients. More specifically, such items are preferably selected from a predetermined product formulary that best suits the practice of the doctor's office. Items may be selected from an inventory of commonly used solid oral medications, injectables, suspensions, creams and ointments. Either brand-name medications or high quality generic medications may be provided.

Accordingly, there exists a need for a system for manually dispensing of prescription drugs at point-of-care facility using patient-ready bottles. Furthermore, there exists a need in the art for a dispensing system wherein the patient-ready bottles may be prepackaged into a self-contained dispensing cartridge. Additionally, there exists a need in the art wherein the cartridges can be easily loaded into a storage locker or cabinet that can be locked to prevent or deter unauthorized access thereinto. Furthermore, there exists a need in the art for a dispensing system wherein the cabinet is not readily portable in order to deter theft of certain controlled substances that may be stored in the cabinet.

Also, there exists a need in the art for a dispensing system wherein the cartridges may be easily loaded into the cabinet after which the patient-ready bottles may be dispensed in one-at-a-time fashion. Furthermore, there exists a need in the art for dispensing system wherein the cabinets may accommodate cartridges of various sizes for accommodating different quantities of bottles. Finally, there exists a need in the art for a dispensing system wherein the cartridge and cabinets are of simple construction and of low cost.

BRIEF SUMMARY OF THE INVENTION

The present invention specifically addresses the need associated with point-of-care dispensing. More specifically, the present invention is drug dispensing system which comprises a cabinet having a plurality of cartridges disposed therewithin. Each one of the cartridges may contain a plurality of containers or vials into which medications such as prescription drugs and/or controlled substances may be packaged. The vials may be generally cylindrically shaped and may be removed from a vial opening formed in the cartridge. The vial opening may be formed manually by removing a punch-out that is formed along tear lines provided in each one of the cartridges.

The cabinet has opposing door portions which may be hingedly attached to one another along a hinge. The door portions are preferably closable against one another in sealing engagement and may include a lock member such that the door portions may be locked to one another to deter unauthorized access to controlled substances in compliance with DEA regulations. Each one of the cabinets may include a plurality of the shelves for storing a plurality of the cartridges. The door portions include a top wall, a bottom wall, a pair of end walls and a back wall.

The door portions may be pivoted open to a 180° arrangement to reveal the cartridges. Each one of the shelves may be mounted to an inner side wall of the door portion. Opposite ends of the shelf may include mounting brackets which allow for vertical adjustment of the shelf in order to accommodate cartridges of varying heights. The back wall may include apertures from which the door portion may be hung from a back of a door or wall. Each one of the shelves may have an upwardly turned lip such that the cartridge may be retained by the lip when the cartridge is stored or placed on the shelf.

Each one of the cartridges is preferably configured to store a plurality of the vials therewithin. The cartridges may have a generally rectangular cross sectional shape and may be fabricated of varying heights depending on the quantity of vials to be stored therewithin. Each one of the cartridges includes a top panel and a bottom panel interconnected by a front panel, a back panel and a pair of side panels. A vial opening is provided in the front panel and side panels of the cartridge to enable removal of one of the vials. The top panel of each one of the cartridges is hingedly openable to facilitate loading of the vials into the cartridge. The vial opening is manually generated by removal of a punch-out formed as a series of contiguous tear lines in the front panel and side panels.

In the flat, unassembled state, each one of the cartridges is comprised of the top panel, side panels, front panel and back panel foldably connected to one another along a plurality of fold lines which extend orthogonally along the cartridge in the unassembled state. When folded, the cartridge defines a generally enclosed interior compartment that is sized and configured to dispensibly store the vials.

The ability to disassemble and unfold the cartridge into the flat planar material facilitates shipping, storage and handling of the cartridges. Furthermore, by fabricating the cartridge out of cardboard, costs are reduced with the added benefit that cardboard is generally biodegradable to enhance its disposability.

BRIEF DESCRIPTION OF THE DRAWINGS

These as well as other features of the present invention will become more apparent upon reference to the drawings wherein.

DETAILED DESCRIPTION OF THE INVENTION

Figure 1:
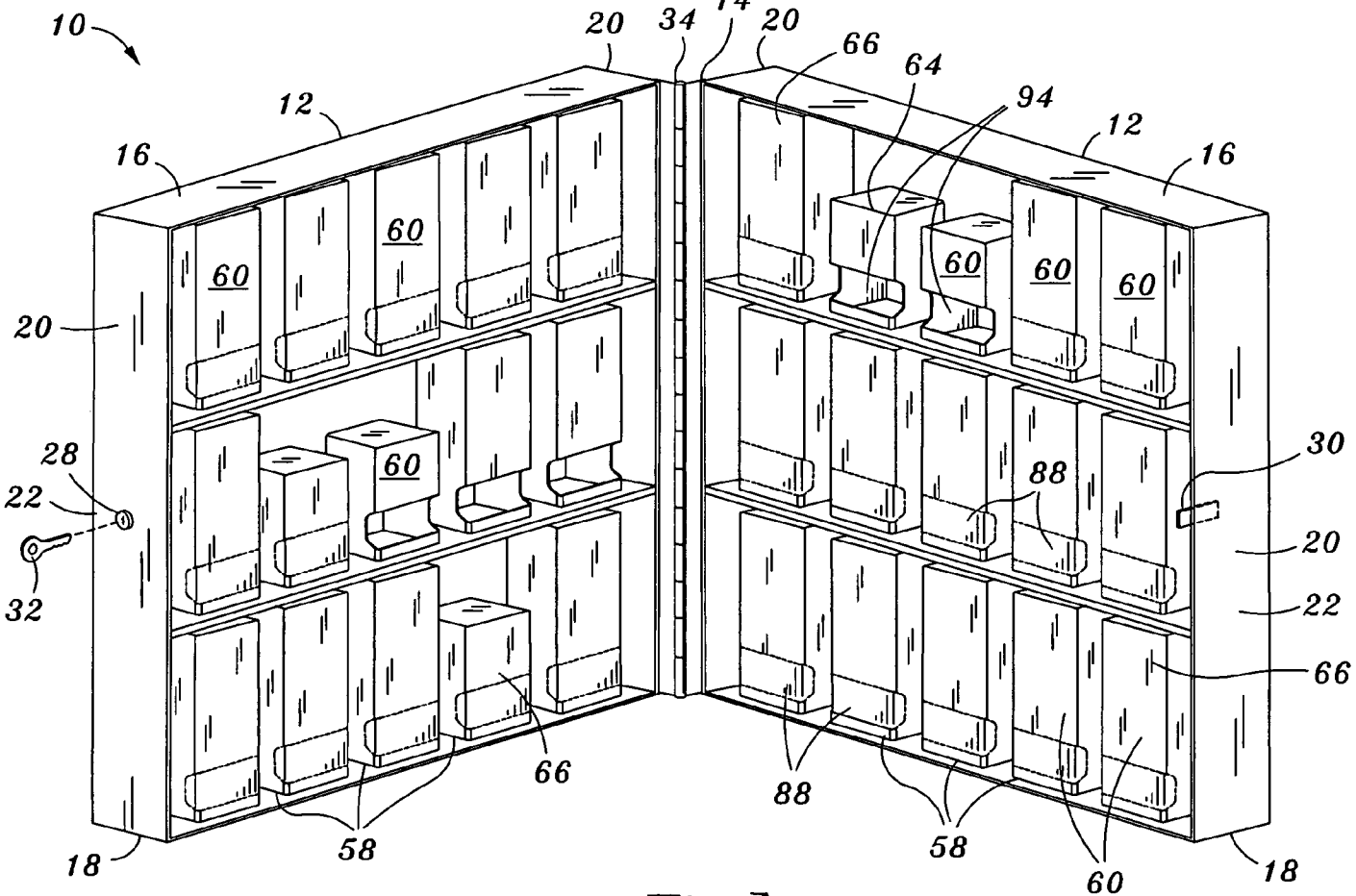
FIG. 1 is a perspective view of a drug dispensing system of the present invention illustrating a cabinet having opposed door portions hingedly connected to one another and further illustrating a plurality of cartridges placed on shelves within the door portions.

Referring now to the drawings wherein the showings are for purposes of illustrating the present invention and not for purposes of limiting the same, FIG. 1 illustrates a perspective view of a drug dispensing system 10 of the present invention. In its broadest sense, the drug dispensing system 10 comprises a cabinet 14 having a plurality of cartridges 60 disposed therewithin. The cartridges 60 may contain a plurality of containers or vials 96 (shown in FIG. 6). Medications such as prescription drugs and/or controlled substances may be packaged within the vials 96. The vials 96 may also be packaged with vitamins and neutraceuticals. As is common in the drug industry, the bottles or vials 96 typically comprise a vial body which is generally a hollow tubular member having a cap such as a childproof cap disposed on an end of the vial body.

Figure 6:
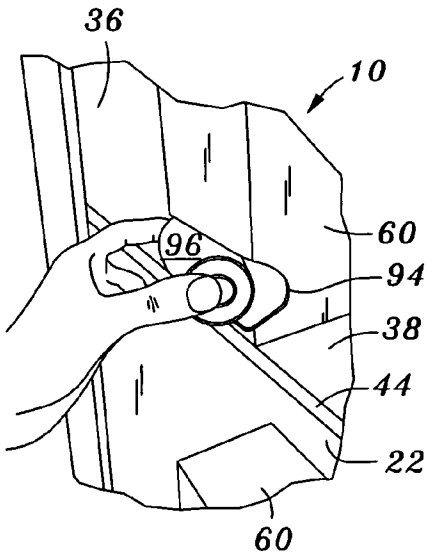
FIG. 6 is a partial perspective view of a user removing a vial from the vial opening of one of the cartridges.

As can be seen in FIG. 6, the vials 96 may be generally cylindrically shaped and may be removed from a vial opening 94 formed in the cartridge 60 which can be seen mounted on a shelf 38 of the cabinet 14. As will be described in greater detail below, the vial opening 94 may be formed manually by removing a punch-out 88 that is formed along tear lines 92 provided in each one of the cartridges 60.

Referring to FIG. 1, the cabinet 14 is shown as having opposing door portions 12 which may be hingedly attached to one another along a hinge 34. The door portions 12 are preferably identical to one another in regard to overall height and width such that the door portions 12 are closable against one another in sealing engagement. A lock member 28 may be included on at least one of the door portions 12 and which may be engageable to a lock latch 30 disposed on an opposing one of the door portions 12 such that the door portions 12 may be locked to one another to deter unauthorized access to substances stored therewithin in compliance with DEA regulations.

The lock member 28 may be accessible via a key 32 which may be inserted thereinto as is commonly used in conventional door locks. Each one of the cabinets 14 may include a shelf 38 for placing of the cartridges 60 therewithin. Furthermore, each one of the door portions 12 may include a plurality of the shelves 38 for storing a plurality of the cartridges 60 as well as storing various other medications such as suspensions, creams and ointments.

Figure 5B:
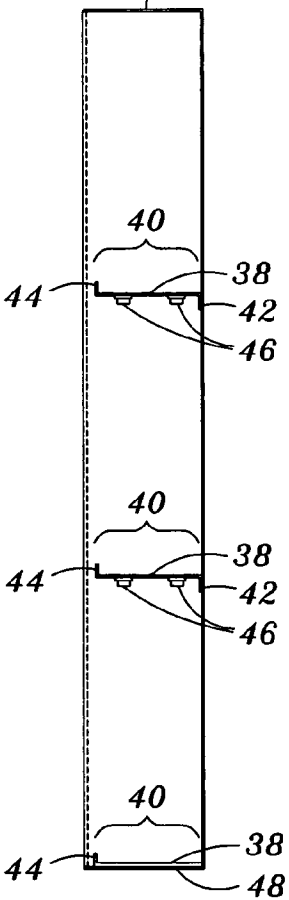
FIG. 5B is a section cut taken along line 5B-5B of FIG. 5A and illustrating each one of the shelves having an upwardly turned lip formed thereon for retaining the cartridge on the shelf.
Figure 5A:
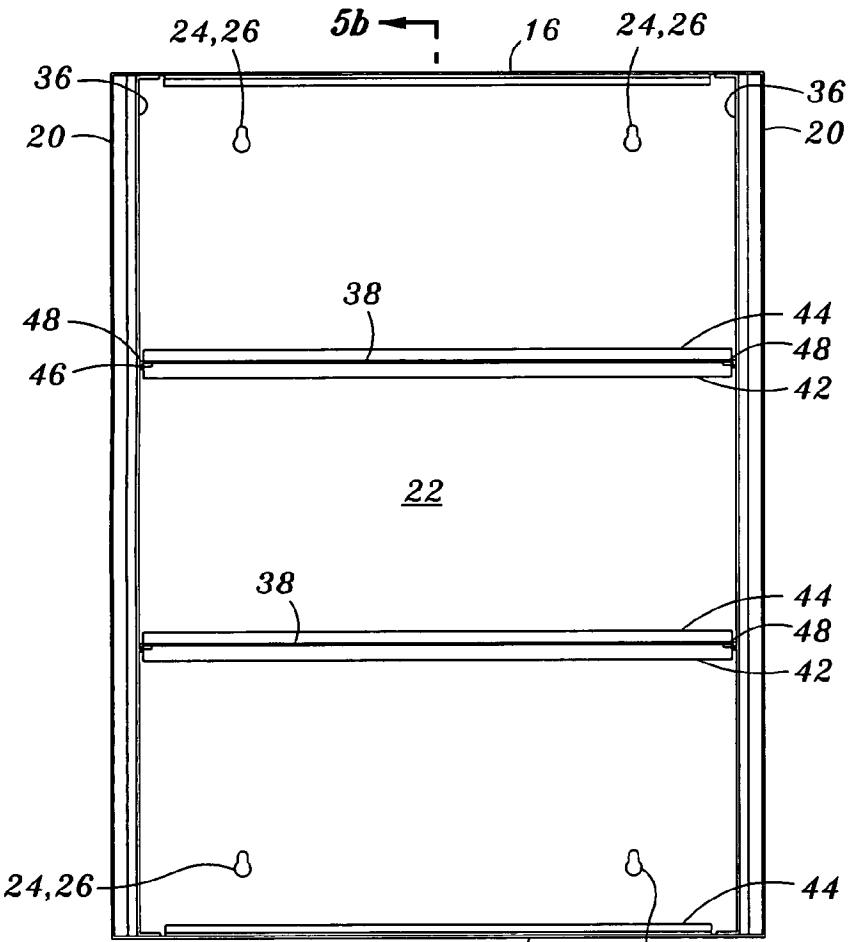
FIG. 5A is a front view of one of the door portions of the cabinet and illustrating horizontally oriented shelves disposed therewithin.

Referring now to FIGS. 5A-5B, shown is one of the door portions 12 having three of the shelves 38 disposed in horizontal arrangement. As can be seen, each one of the door portions 12 includes a top wall 16, a bottom wall 18, a pair of end walls 20 and a back wall 22. As can be seen in FIG. 1, the door portions 12 are adjoined at the respective ones of the end walls 20 by the hinge 34. In this manner, the door portions 12 may be pivoted open to a 180° arrangement to reveal the contents. In the closed position, the door portions 12 are hingedly closed against one another and may be locked using the lock member 28 and lock latch 30. The hinge 34 preferably runs the length of the end walls 20 to provide sufficient structural integrity of the door portions 12 in relation to one another.

As shown in FIG. 5A, each one of the shelves 38 has opposing ends which may be mounted to an inner wall 36 which is slightly spaced apart from the end walls 20 of the door portion 12. Opposite ends of the shelf 38 may include mounting brackets 46 which are configured to allow for vertical adjustments of the shelf 38 in order to accommodate different configurations of the cartridge 60 (i.e., cartridges of varying heights). More specifically, each one of the shelves 38 of the door portions 12 is preferably configured to be vertically adjustable in order to accommodate a four-vial cartridge 62, a six-vial cartridge 64 and/or a ten-vial cartridge 66. It is contemplated that the mounting brackets 46 may be engageable to holes formed in the inner walls 36.

As can be seen in FIG. 5A, the back wall 22 may include at least one aperture 24 and preferably a plurality of apertures 24 from which the door portion 12 may be hung from a back of the door or from a wall in compliance with DEA regulations. Each one of the apertures 24 is preferably formed in a keyhole 26 shape such that the door portion 12 may be easily hung or suspended from screws that may be extended into the door or wall. Referring briefly now to FIG. 5B, shown are the shelves 38 having an upwardly turned lip 44 on a free side of the shelf 38. Each one of the shelves 38 may also include a flange 42 running the length of the shelf 38 on an opposite side of the shelf 38 (i.e., the back of the shelf). The flange 42 provides a means by which the shelf 38 may be attached to the back wall 22 of the door portion 12.

Preferably, the shelf 38 has a shelf depth 40 which is dimensioned to be complementary to a depth of the cartridge 60 such that the cartridge 60 may be stored on the shelf 38. More specifically, the cartridge 60 has the cartridge depth that is preferably sized to be complementary to the shelf 40 depth such that the cartridge 60 may be retained by the lip 44 when the cartridge 60 is stored or placed on the shelf 38. In this manner, lateral movement of the cartridge 60 is prevented which secures the cartridge 60 within the shelf 38 preventing dislodging of the cartridge 60 such as may occur during opening of the door portions 12. The bottom one of the shelves 38 as shown in FIG. 5B, may be comprised of the bottom wall 18 of the door portion 12. Alternatively, the shelf 38 with the upwardly turned lip 44 may be provided in abutting contact with bottom wall 18.

It is contemplated that the door portion 12 is fabricated of metallic material such as steel sheet metal which may be formed by bending the sheet metal into the desired dimensional shape (i.e., forming the flange 42 and lip 44 on the shelf 38). The inner side walls 36 are disposed in spaced in relation to respective ones of the end wall 20 of the door portion 12 and may be secured to the bottom wall 18, top wall 16 and back wall 22 of the door portion 12 such as by welding and/or using mechanical fasteners. The shelves 38 may have the flange 42 which is disclosed in abutting relationship to the back wall 22. Vertical adjustment of the shelf 38 is facilitated through the use of the mounting brackets 46 disposed on opposite ends of the shelf 38.

Figure 2:
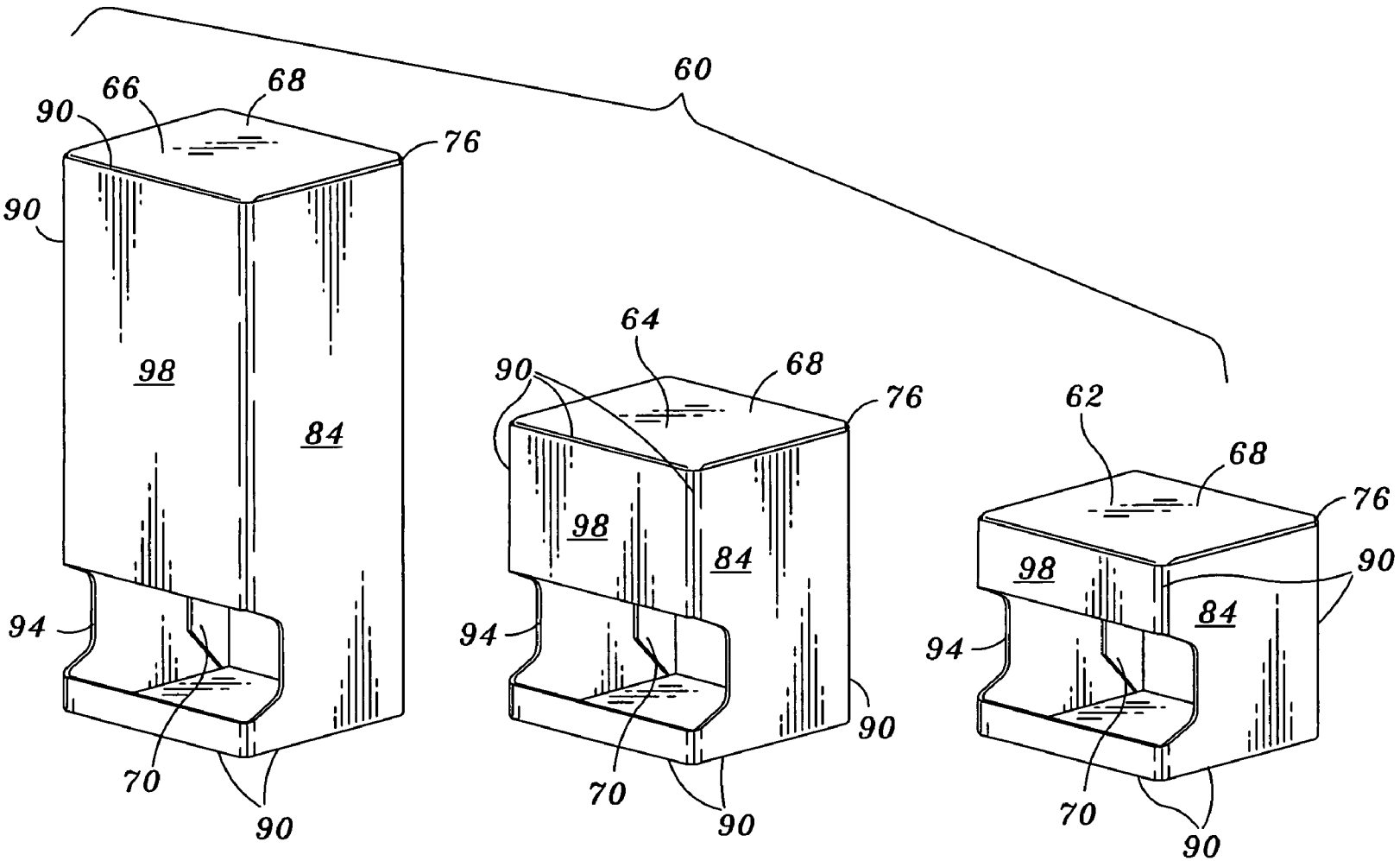
FIG. 2 is a perspective view of a four-vial cartridge, a six-vial cartridge and a ten-vial cartridge and illustrating a vial opening that is manually formed in each one of the cartridges.
Figure 3:
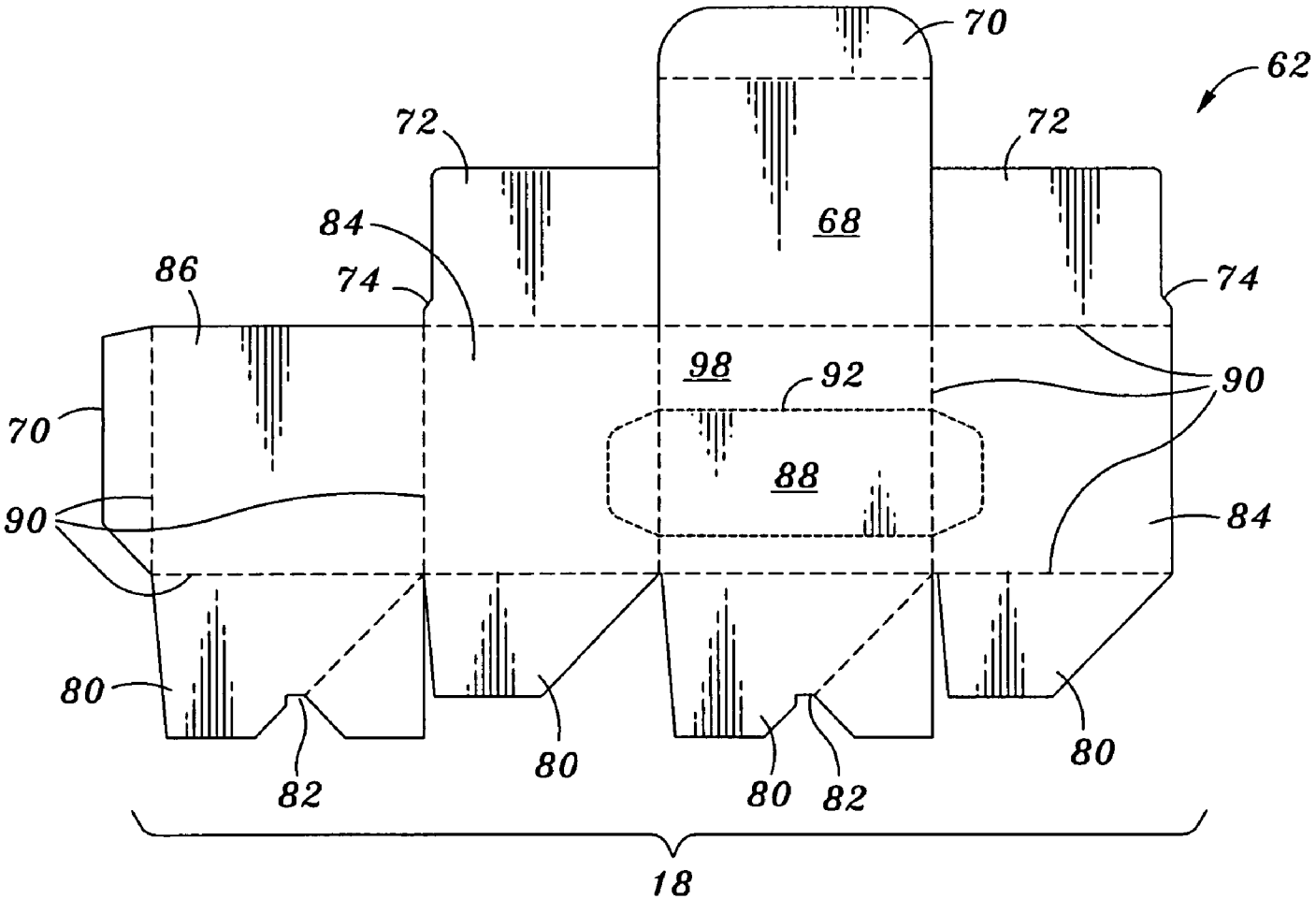
FIG. 3 is a plan view of one of the cartridges in a flat unassembled configuration to facilitate storage and handling of the cartridge.
Figure 4:
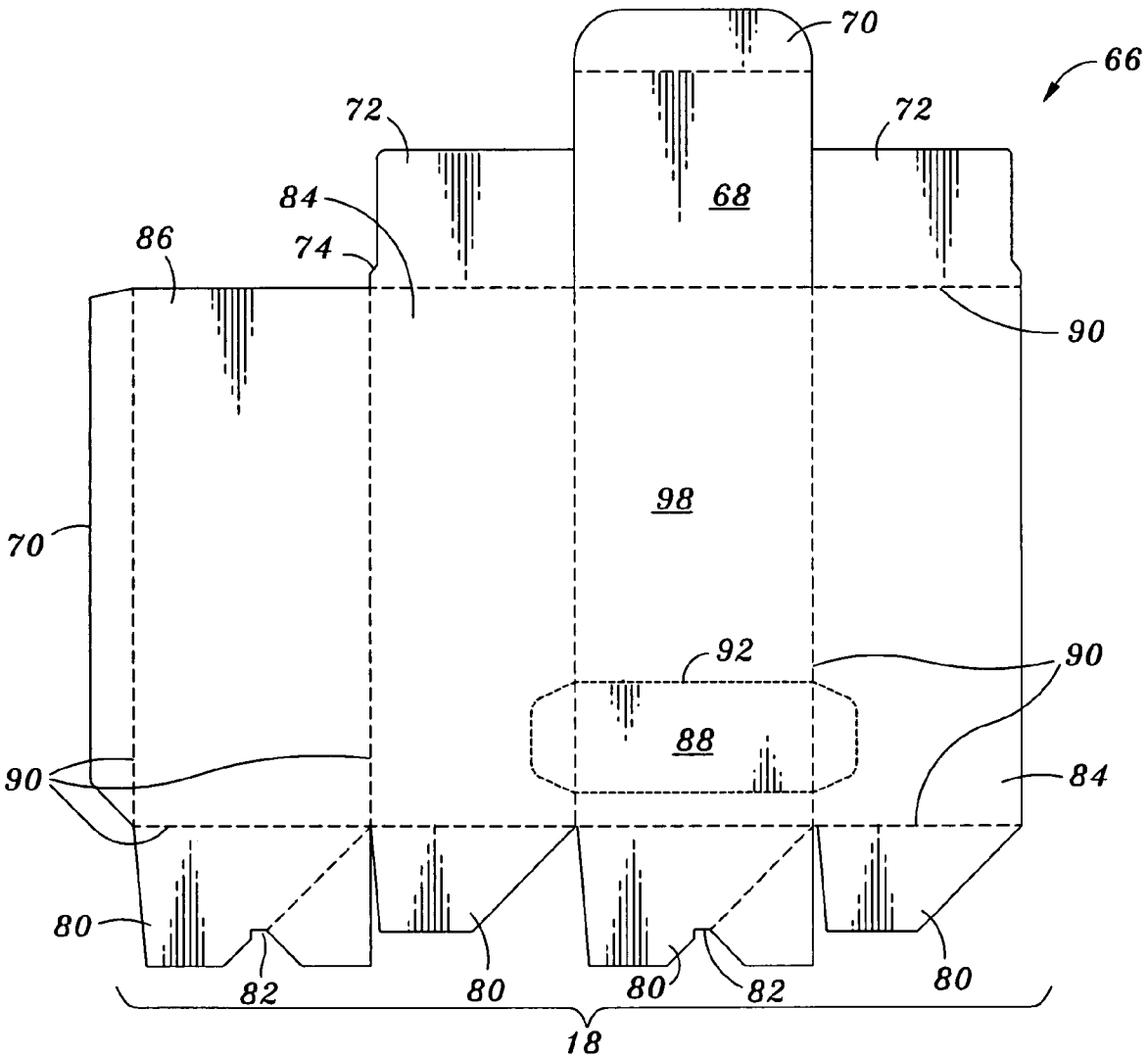
FIG. 4 is a plan view of the ten-vial cartridge in the flat unassembled configuration.

Referring more particularly now to FIGS. 2-4, shown is the cartridge 60 which is configured to be removably supported or stored on the shelf 38. As was earlier mentioned, each one of the cartridges 60 is preferably configured to store a plurality of the vials 96 therewithin. The vials 96 may be configured as shown in FIG. 6 as having a generally cylindrical shape with the end cap disposed thereon. However, it is contemplated that the vials 96 may be configured in any shape including rectangular or oval shapes although the cylindrical shape is believed to be advantageous in allowing for slidable movement of the vials 96 within the cartridge 60 as the vials 96 are dispensed. In this manner, the vials 96 may be readily removed through the vial opening 94 by sliding downwardly into alignment with the vial opening 94.

As can be seen, the cartridges 60 have a generally rectangular cross sectional shape and may be fabricated of varying heights depending on the quantity of vials 96 to be stored therewithin. For example, as shown in FIG. 2, the cartridge 60 may be provided as a four-vial cartridge 62, a six-vial cartridge 64 or a ten-vial cartridge 66. With the four-vial cartridge 62, it is contemplated that the cartridge 62 is configured to contain of the four vials 96 in a horizontal orientation wherein the vials are stacked in two columns of two vials. Likewise, for the six-vial cartridge 64, it is contemplated that the cartridge 60 is configured to contain six of the vials in horizontal orientation wherein the vials 96 are stacked in two columns of three vials.

Finally, if provided in the ten-vial cartridge 66, the cartridge 60 is preferably configured to contain ten of the vials 96 in horizontal orientation wherein the vials are stacked in two columns of five vials. However, it should be noted that the cartridge 60 may be configured to contain any number of vials 96 in any number of columns and rows. Furthermore, as was earlier mentioned, the vials 96 may be provided in any shape and size with the cartridge 60 preferably being formed complementary thereto to contain multiples ones of the vials 96. In this regard, it is contemplated that the shelves 38 may have a shelf depth 40 that is complementary to the cartridge depth which, therefore, is dependant upon the shape and size of the vials 96 to be contained within the cartridge 60.

Each one of the cartridges 60 includes a top panel 68 and a bottom panel 78 interconnected by a front panel 98, a back panel 78 and a pair of side panels 84. A vial opening 94 is provided in the front panel 98 and side panels 84 of the cartridge. More specifically, as can be seen in FIG. 2, the vial opening 94 is preferably disposed at a lower portion of the front panel 98 and is spaced slightly upwardly from the bottom panel 78 in order to prevent inadvertent or unwanted removal of the vials 96 contained therewithin. In this regard, the vial opening 94 is preferably spaced slightly upwardly from the bottom panel 78 to enable removal of one of the vials 96 yet preventing the vials 96 from rolling or otherwise escaping out of the vial opening 94. The vial opening 94 in each one of the cartridges 60 allows access to the interior chamber. The top panel 68 of each one of the cartridges 60 is preferably hingedly removable to facilitate loading of the vials 96 into the interior compartment. As can be seen, the vial opening 94 is manually generated by removal of a punch-out 88 which may be formed as a series of contiguous tear lines 92 provided in the front panel 98 and side panels 84.

Referring now to FIGS. 3 and 4, in the flat, unassembled state, each one of the cartridges 60 is comprised of the top panel 68, side panels 84, front panel 98 and back panel 78 foldably connected to one another along a plurality of fold lines 90 which extend orthogonally along the cartridge 60 in the unassembled state. When folded as shown in FIG. 2, the cartridges 60 define the generally enclosed interior compartment that is preferably sized and configured to dispensibly store the vials 96. As was earlier mentioned, the top panel 68 is preferably hingedly openable along one of the fold lines 90 to facilitate loading of the vials 96 into the interior compartment.

Each one of the side panels 84 may include a top flap 72 which is foldably connected to the side panel 84. Likewise, each one of the top flaps 72 preferably has a slight joggle 74 formed along one edge of the top flap 72. When the cartridge 60 is folded along the fold lines 90, the joggles 74 and the back panel 78 collectively form a slot 76 for receiving the top panel tab 70 thereinto when the top panel 68 is closed. In this manner, when the top panel 68 is open, the vials 96 can be easily loaded into the interior compartment of the cartridge 60 after which the top panel tab 70 can be inserted between the joggles 74 and back panel 78 in order to close the interior compartment.

Referring still to FIGS. 3 and 4, the bottom panel 78 is comprised of a plurality of bottom flaps 80 which extend from respective ones of the back panel 78 and the side panels 84. In this regard, the bottom flaps 80 are foldably connected along the fold lines 90 to respective ones of the front 98, back 86 and side panels 84. When the cartridge is folded up for use, the bottom flaps 80 preferably overlap one another and are generally securable together to form a structurally sound bottom panel 78 that resists opening when the cartridge 60 is loaded with vials 96. Regarding the particular configuration of the bottom flaps 80, it can be seen that notches 82 may be provided in the sides of the bottom flaps 80 such that opposing ones of the bottom flaps 80 extending from the front 98 and back panels 78 may be interconnected with the bottom flaps 80.

The bottom flaps 80 extending from the side panels 84 are overlapped with the bottom panels that extend from the front 98 and back panels 78 in order to provide a secure bottom panel 78 that resists gravitational forces imposed by vials 96 loaded in the interior compartment. The generally closed cross sectional shape of the cartridge 60 is achieved when a folding tab 70 extending from one of the side panels 84 is connected to the opposite one of the side panels 84. It is contemplated that the tab 70 may be connected to the opposite one of the side panels 84 using adhesive and/or mechanical fasteners.

Also shown in FIGS. 3 and 4 is a top flap 72 extending from respective ones of the side panels 84. As was earlier mentioned, the top flaps 72 may include joggles 74 formed on at least one edge thereof to collectively define a slot 76 with the back panel 78 and into which the tab 70 from the top panel 68 may be inserted. Additionally, the top flaps 72 may provide an additional measure of structural integrity to the cartridge 60 in the event that the cartridge 60 is turned upside down when vials 96 are loaded therewithin. In this manner, the top flaps 72 cooperate with the top panel 68 to prevent the vials 96 from forcing the top panel 68 open and spilling out of the cartridge 60.

Importantly, as can be seen, the cartridge 60 is initially provided in the unassembled state and is fabricated of a single piece of planar material. Although any suitable 70 material may be used, cardboard is a preferable material. The cardboard may be corrugated cardboard or it may be a single laminate of cardboard. Preferably, the cartridge 60 is pre-assembled into an auto-bottom arrangement wherein the cartridge 60 can be formed into its operative configuration merely by popping open and closing the top flap. Advantageously by providing the cartridge 60 in an unassembled state, various markings such as instructions of use may be easily applied to outer surfaces of the cartridge 60 such as on the side 84 and front panels 98 of the cartridge. It is further contemplated that other markings such as advertising for such point-of-care dispensing systems may be provided on the side 84 and front panels 98.

Furthermore, the ability to disassemble and unfold the cartridge 60 into the flat planar material simplifies marking/labeling as well as simplifying shipping, storage and handling of the cartridges 60. Furthermore, by fabricating the cartridge 60 out of cardboard, costs are reduced with the added benefit that cardboard is generally biodegradable to enhance its disposability. As shown in FIGS. 2, 3 and 4, a punch-out 88 may be provided in the cartridge 60 wherein a user may manually generate the vial opening 94 to allow access to the vials 96 stored in the interior compartment of the cartridge 60. As can be seen in FIGS. 3 and 4, each one of the cartridges 60 may include contiguous tear lines 92 that may be provided along the front panel 98 and side panels 84 such that the punch-out 88 may be manually removed by the user.

Although shown with a generally rectangular shape having slightly tapering tear lines 92 in the side panels 84, it is contemplated that the punch-out 88 may be provided in any shape such as an oval shape. Furthermore, the punch-out 88 may be provided along any portion of any panel of the cartridge 60 although the front panel 98 is a preferred location. In this regard, it is contemplated that the punch-out 88 could be generally oriented on the side panel 84 between the back panel 78 and front panel 98. In order to facilitate removal of vials 96 from the vial opening 94, it is contemplated that the punch-out 88 is generally sized and configured to be complementary to the shape and size of the vials 96.

Furthermore, when placed in the use (i.e., folded up) configuration, it is contemplated that the cartridge 60 is geometrically sized to be compatible with the vials 96. More specifically, because the vials 96 are stored within the interior compartment in a generally horizontal orientation, the width of the front panel 98 is preferably generally equal to or slightly greater than the length of each one of the vials 96. Likewise, the back panel 78 is generally sized to be generally equal to that of the front panel 98. The side panels 84 are preferably sized to be complementary to double the width of the vial 96 such that two columns of vials 96 may be stored in one cartridge 60.

Referring briefly now to FIG. 1, shown in the drug dispensing system 10 are a plurality of cartridges 60 stored on each one of the shelves 38. As shown in FIG. 1, five cartridges 60 are stored in generally side-by-side arrangement on the shelf 38. However, four of the cartridges may be stored in the shelf 38 such that the shelf 38 defines a shelf length which is specifically configured to accommodate four of the cartridges 60 in side-by-side arrangement. It should be noted that any number of cartridges 60 may be provided and stored on the shelves 38 in side-by-side arrangement. It should also be noted that spacers 58 may be inserted between adjacent ones of the cartridges 60 in order to equally space the cartridges 60 apart from one another.

The cabinet 14 and, hence, the door portions 12 may be provided in a variety of sizes. For example, the cabinet 14 may be provided in a small size suitable for accommodating up to 24 dispensing cartridges 60 with four cartridges 60 being installed or stored on each of three shelves 38 disposed in each of the two door portions 12. A larger size of the cabinet 14 may be configured to hold at least forty of the cartridges 60. If the ten-vial cartridges 66 are exclusively stored on the shelves 38, it is contemplated that at least four hundred and eighty (480) vials 96 may be stored in one of the cabinets 14. As can be seen, any number of cartridges 60 having a variety of different configurations (i.e., four-vial cartridge 62, six-vial cartridge 64 and ten-vial cartridge 66), may be stored within the cabinet 14.

The operation of the drug dispensing will now be discussed with reference to FIGS. 1-6. Each one of the cartridges 60 may be initially provided in the unassembled or flat state as shown in FIGS. 3-4. The cartridge 60 is comprised of a top panel 68, a bottom panel 78, a front panel 98, a back panel 78 and a pair of side panels 84 foldably connected to one another along a plurality of fold lines 90, as was described above. As can be seen in FIGS. 3-4, the top panel 68 is completely separated from top flaps 72 disposed on either side of the top panel 68 such that the top panel 68 can move independently of the top flaps 72 to allow for folding of the top panel 68 along the fold line 90. Likewise, the bottom flaps 80 which comprise the bottom panel 78 are each constructed to be movable and formable along the fold lines 90.

The bottom flaps 80 are thus independent of one another such that when the cartridge 60 is folded up into the use configuration, the bottom flaps 80 may be overlapped and interlocked with one another. Assembly of the cartridge 60 into the use configuration is accomplished by folding the side panels 84, back panel 78 and front panel 98 along the four vertically oriented fold lines 90. The tab 70 extending from the side panel 84 may then be connected to the opposing one of the side panels 84 (such as via adhesive) to form a generally closed, orthogonally-shaped cross section. The bottom flaps 80 may be folded upwardly into interlocking and/or overlapping arrangement with one another and may be secured together via adhesive and/or mechanical fastenings such as stapling.

Vials 96 containing the desired types of prescription drugs may be then loaded into the interior compartment of the cartridge 60 and a generally horizontal orientation. It is configured as shown in FIG. 2, the vials 96 are preferably loaded in columns of two, and in two rows for the four-vial cartridge 62, up to three rows for the six-vial cartridge 64, up to five rows, for the ten-vial cartridge 66. The cartridges 60 may then be loaded into the cabinet 14 and be placed on the shelves 38 in the appropriate location. The cabinet 14 may be moved to the desired location such as by mounting on a wall or door. During periods of non-use, the door portions 12 may be closed and/or locked to one another.

During dispensing of operations, the door portions 12 may be opened along the hinge 34 revealing the cartridges 60 stored therewithin. Upon identifying the type of prescription drug to be dispensed, the user manually removes the punch-out 88 by pressing inwardly along the tear lines 92 to break away and remove the punch-out 88 from the front panel 98 and side panels 84. The vial opening 94 that is formed by removal of the punch-out 88 allows access to individual ones of the vials 96 stored within the cartridge 60. The user then removes the vial 96 presented adjacent the vial opening 94 after which the vials 96 stored on top of the just-dispensed vial 96 move freely downwardly into alignment with the vial opening 94.

Removal of subsequent vials 96 simply entails the user grasping the vial 96 located adjacent the vial opening 94 and removing the vial 96 therefrom. A variety of drugs and prescriptions may be dispensed in this manner by simply identifying the type of desired drug to be dispensed and locating the cartridge 60 which contains such drug. Upon completion of dispensing operations, the door portions 12 may be closed against one another and may be locked together. Upon depletion of the contents of vials 96 in any of the cartridges 60, a user may simply reload the desired replacement cartridge 60 on the shelf 38. Advantageously, the upwardly turned lip 44 which extends along the length of each one of the shelves 38 prevents lateral movement and spillage of the cartridges 60 out of the door portions 12 when the door portions 12 are being opened. The cardboard from the depleted cartridge 60 may be easily disposed of such as by recycling or incineration.

Additional modifications and improvements of the present invention may also be apparent to those of ordinary skill in the art. Thus, the particular combination of parts described and illustrated herein is intended to represent only certain embodiments of the present invention and is not intended to serve as limitations of alternative devices within the spirit and scope of the invention.

What is claimed is:

1. A drug dispensing system, comprising:

a cabinet having opposing door portions hingedly attached to one another, each one of the door portions including at least one shelf; and at least one cartridge removably supported on the shelf, each one of the cartridges being configured to store a plurality of vials and having a punch-out disposed on a lower end thereof and through which the vials may be dispensed from the cartridge.

2. The drug dispensing system of claim 1 wherein the cabinet includes a lock member for locking the door portions together.

3. The drug dispensing system of claim 1 wherein at least one of the door portions includes three of the shelves.

4. The drug dispensing system of claim 1 wherein the cartridge is configured to contain four of the vials in horizontal orientation and being stacked in two columns of two vials.

5. The drug dispensing system of claim 1 wherein the cartridge is configured to contain six of the vials in horizontal orientation and being stacked in two columns of three vials.

6. The drug dispensing system of claim 1 wherein the cartridge is configured to contain ten of the vials in horizontal orientation and being stacked in two columns of five vials.

7. The drug dispensing system of claim 1 wherein the cartridge is comprised of a top panel, a bottom panel, a front panel, a back panel and a pair of side panels foldably connected to one another along a plurality of fold lines and defining an interior compartment sized and configured to dispensibly store the vials.

8. The drug dispensing system of claim 1 wherein a series of contiguous tear lines are provided in the front panel and side panels such that the punch-out may be manually removed.

9. The drug dispensing system of claim 1 wherein the top panel is hingeably openable along one of the fold lines for loading the vials into the interior compartment.

10. The drug dispensing system of claim 1 wherein:

each of the side panels includes a top flap foldably connected thereto;

each one of the top flaps having a joggle formed along an edge thereof;

the joggles and back panel collectively forming a slot for receiving the top panel tab thereinto when the top panel is closed.

11. The drug dispensing system of claim 1 wherein the bottom panel is comprised of a plurality of bottom flaps foldably connected to respective ones of the front, back and side panels, the bottom flaps overlapping one another and being securable together to form the bottom panel.

12. The drug dispensing system of claim 1 wherein one of the side panels includes a folding tab extending therefrom and being connectable to the other one of the side panels such that the cartridge defines a closed cross-section.

13. The drug dispensing system of claim 12 wherein the tab is connected to the side panel using adhesive.

14. The drug dispensing system of claim 1 wherein the cartridge is configured to be fabricated of a single piece of planar material.

15. The drug dispensing system of claim 14 wherein the material is cardboard.

16. The drug dispensing system of claim 1 wherein at least one of the door portions includes a back panel having a plurality of apertures formed therein for suspending the cabinet.

17. The drug dispensing system of claim 16 wherein the apertures are formed in the shape of a keyhole.

18. The drug dispensing system of claim 1 wherein opposite ends of the shelf include mounting brackets configured to allow for vertical adjustment of the shelf.

19. The drug dispensing system of claim 1 wherein the shelf defines a shelf length configured to accommodate four of the cartridges in side-by-side arrangement.

20. A drug dispensing system, comprising:

a cabinet having opposing door portions hingedly attached to one another and being configured to be closeable against one another, each one of the door portions including at least one shelf defining a shelf depth and having an upwardly turned lip; and at least one cartridge having a cartridge depth that is sized to be complementary to the shelf depth such that the cartridge is retained by the lip when the cartridge is placed on the shelf, each one of the cartridges being configured to store a plurality of vials and having a punch-out disposed on a lower end thereof and through which the vials may be dispensed from the cartridge.

* * * * *